US009439482B2

(12) United States Patent
Murray et al.

(10) Patent No.: US 9,439,482 B2
(45) Date of Patent: Sep. 13, 2016

(54) INTERLOCKING RING SYSTEM AND DEVICE WITH INTERCHANGEABLE OUTER JACKETS AND CENTER RINGS CALLED A TULIP

(71) Applicants: Todd E Murray, Muncie, IN (US); Jane A Murray, Muncie, IN (US)

(72) Inventors: Todd E Murray, Muncie, IN (US); Jane A Murray, Muncie, IN (US)

( * ) Notice: Subject to any disclaimer, the term of this patent is extended or adjusted under 35 U.S.C. 154(b) by 180 days.

(21) Appl. No.: 14/294,634

(22) Filed: Jun. 3, 2014

(65) Prior Publication Data

US 2015/0121958 A1 May 7, 2015

Related U.S. Application Data

(60) Provisional application No. 61/900,567, filed on Nov. 6, 2013.

(51) Int. Cl.
*A44C 9/00* (2006.01)

(52) U.S. Cl.
CPC ..... *A44C 9/0023* (2013.01)

(58) Field of Classification Search
None
See application file for complete search history.

(56) References Cited

U.S. PATENT DOCUMENTS

| | | | | |
|---|---|---|---|---|
| 2,117,176 A * | 5/1938 | Keehnel | ..... | A44C 9/0023 63/15.4 |
| 2,151,607 A | 3/1939 | Lovell | | |
| 2,262,513 A | 11/1941 | Novack | | |
| 2,408,982 A | 10/1946 | Koenig | | |
| 2,761,294 A | 9/1956 | Lund | | |
| 4,493,196 A | 1/1985 | Bogner et al. | | |
| 5,027,617 A | 7/1991 | Bonchek | | |
| 5,228,316 A | 7/1993 | Meyrowitz | | |

FOREIGN PATENT DOCUMENTS

| | | | | |
|---|---|---|---|---|
| EP | 0668033 | 8/1995 | | |
| FR | 2581295 A * | 11/1986 | ..... | A44C 9/0023 |
| FR | 2783404 A * | 3/2000 | ..... | A44C 9/0023 |

* cited by examiner

*Primary Examiner* — Jack W Lavinder
(74) *Attorney, Agent, or Firm* — Ritchison Law Offices, PC; John D Ritchison

(57) ABSTRACT

A jewelry ring configuration having interchangeable elements and especially jewelry rings which have a decorative feature mounted on a center ring. This new device/process may be simply described as a device for an interlocking ring system and device with interchangeable outer jackets and center rings comprised with a center ring, ornate and decorative or smooth and with or without gemstones, the center ring in various mounting styles such as prong, bezel, pave etc.; and a jacket as an outer band, held together by one or more straps, the jacket being ornate and with or without gemstones and made of the same, complimentary or contrasting materials as the center ring wherein the interchangeable outer jackets and center rings provide an interchangeable, stylish combination of interlocking jackets and center rings.

8 Claims, 9 Drawing Sheets

SECT EE
SECT DD
SECT CC
SECT BB
SECT AA
44 Optional
44A Optional
2B
2B

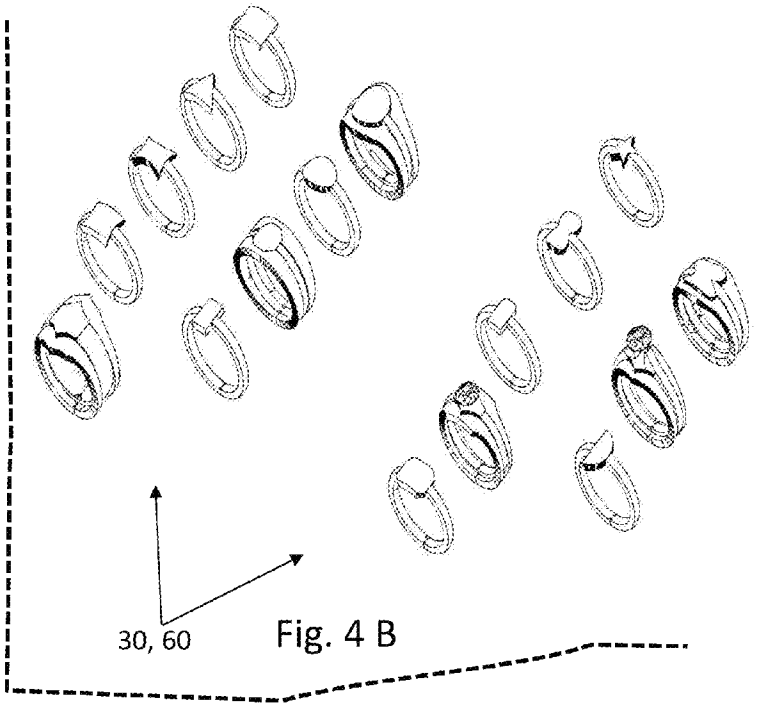
Fig. 4 B
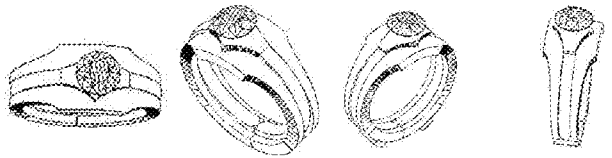
Fig. 4 D
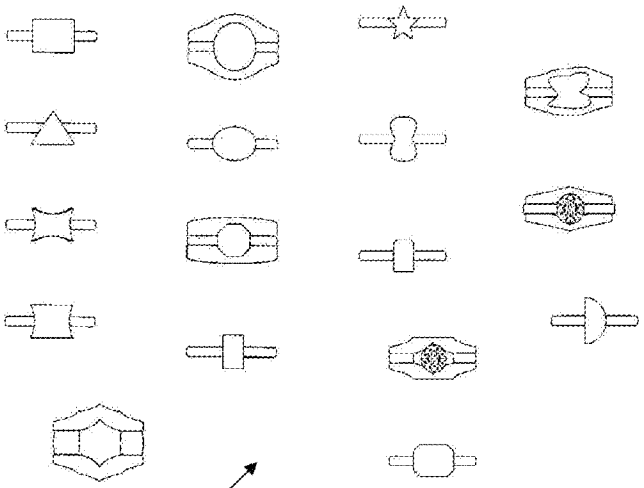
Fig. 4 A
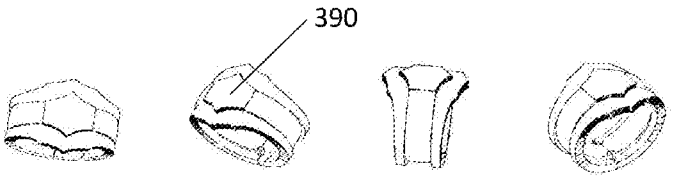
Fig. 4 C
Figs. 4

INTERLOCKING RING SYSTEM AND DEVICE WITH INTERCHANGEABLE OUTER JACKETS AND CENTER RINGS CALLED A TULIP

CROSS-REFERENCE TO RELATED APPLICATIONS

This application claims the benefit of Provisional Patent Application Ser. No. 61/900,567 filed Nov. 6, 2013 by Todd and Janie Murray and entitled "An Interlocking Ring System and device with Interchangeable Outer Jackets and Center Rings called a TULIP".

FIELD OF INVENTION

This invention relates to jewelry having interchangeable elements and especially to jewelry rings which have a decorative feature mounted on a center ring. This invention relates to a finger ring comprising an outer jacket and an inner center ring and, more particularly, to a finger ring, the center ring or plug of which is held contiguous and non-rotating by the configuration to an outer ring. Further, this invention relates generally to rings adapted to be worn on a person's finger, and in particular to a ring comprising detachably coupled members to permit replacement of the members. Moreover, the invention relates to a dual ring set which is generally worn on one finger. The dinner or engagement/wedding ring combination is generally a band with a single ornamental stone, often a diamond or precious gem, or at most a cluster of ornamental stones concentrated in a limited portion of the band and a band with ornamentation with or without gemstones.

BACKGROUND

Field of Invention and Prior Art

A. Problem Addressed:

Common problems in this area are that the old style jackets or band sets would not hold center rings in center of jacket. Therefor a jeweler would have to solder or fasten them together in some manner to keep them lined up. Also, previous jacket rings would not hold a center ring aligned properly. If one has the jacket and center soldered, then once the two rings are together they cannot be separated without un-soldering and re-polishing the separate pieces. These problems and shortfalls are remedied by the interlocking ring system and device with interchangeable outer jackets and center rings presented here and called a TULIP.

This invention addresses these problems by: A new device and system made of durable and formable materials that are configured to lock a center ring into alignment without soldering therefor all center rings and a jacket that have the same locking configuration are fully interchangeable; and a locking shape and configuration which allows all the center rings and jackets to be interchangeable with perfect alignment without soldering the jacket and center ring together.

B. Prior Art

The principal shortcoming of the great bulk of the prior art is that these former developments are not relatively adaptable to interchangeable, cast ring constructions of the type used. For example, this is the case in engagement rings and the like, wherein the annular main body portion is formed integrally with the setting for a gem stone and a separate wedding band or multiple wedding bands are involved. Some basic and typical jewelry designs are shown as prior art in FIGS. 7, 8, and 9.

U.S. Pat. No. 5,228,316 issued to Meyrowitz in 1993 shows a ring of the type adapted to worn on a person's finger is comprised of three distinct ring members. Two of the ring members are engageable for capturing the third ring member and are disengageable to allow the removal and replacement of one or more of the ring members. In one embodiment, a first ring member has substantially cylindrical first and second portions, the second portion being enlarged radially with respect to the first portion to define a first shoulder between the first and second portions. A second ring member has substantially cylindrical third and fourth portions, the fourth portion being enlarged radially with respect to the third portion to define a second shoulder between the second and third portions. The first portion is adapted for mating engagement with the third portion, whereby the first and second ring members are joined together. The third ring member is positionable in concentric relationship with the joined first and third portions. The first and second shoulders are adapted to engage opposed first and second faces of the third ring member, to capture the third ring member between the first and second ring members and in fixed concentric relationship with the joined first and third portions. The first and third portions are disengageable, to accommodate removal of the third ring member. The first, second and third ring members are selectively replaceable. Ring members of various types are selectively combinable to yield multiple ring designs and configurations. This fails to show the interchangeable manner provided by the Murray innovation in that no threaded devices or fastening means is required. Also, Murray has fewer parts. Next, U.S. Pat. No. 5,027,617 issued to Bonchek in 1991 shows a dual ring with protector comprises a pair of rings arranged to be worn together on one finger. One of the pair of rings has an integral protective channel which is adapted to receive the second ring of the pair. The second ring of the pair has ornamentation around its circumference which requires protection from scratching, abrasion, and the possibility that the stones worn facing the inside of the hand will fall out if the gold holding them catches on clothing or hits an object. The protective channel of the first ring is adapted to receive the second ring and protects the complete inner portion, facing the inside of the hand, from wear, scratches, abrasion and the possibility that the stones worn facing the inside of the hand will fall out if the gold holding them catches on clothing or hits an object. This fails to show the interchangeable manner provided by the Murray innovation in that there is not a dual sided jacket nor a containment to prevent the center ring from rotating.

U.S. Pat. No. 4,493,196 issued to Bogner, et al in 1985 shows an improved ring construction suitable for rings, bracelets and similar articles of jewelry, in which a metallic braided decorative strip is underpinned to the outer surface of the ring so that the end and side edgings are shielded from accidental contact during wearing by a user. The ends of the braided strip are enclosed beneath a covering lip forming a part of the ring at each end thereof, while the side edges are covered by planar circular plates soldered to the body of the ring. This fails to show the interchangeable manner provided by the Murray innovation in that there is not a dual sided jacket nor a containment to prevent the center ring from rotating. It also has four versus two active parts. Next U.S. Pat. No. 2,761,294 issued to Lund in 1956 and reissued as RE 24798 shows multi parts with threaded fasteners securing the bands. This fails to show the interchangeable manner provided by the Murray innovation in that Murray requires no fasteners and has fewer parts.

U.S. Pat. No. 2,408,982 issued to Koenig in 1944 shows multiple parts and bands with flip-out portions. This fails to show the interchangeable manner provided by the Murray innovation in that Murray is accomplished with fewer parts and is fully interchangeable within a specific locking shape. Next U.S. Pat. No. 2,262,513 issued to Novack in 1941 shows a one-sided jacket, with a "center ring" beside a band. This fails to show the interchangeable manner provided by the Murray innovation in that the center ring is not in an anti-rotate configuration nor is there full interchangeability.

U.S. Pat. No. 2,151,607 issued to Lovell in 1938 shows multiple parts with a single geometric step locking device. More parts and limited interchangeability is taught. Therefore, it fails to show the interchangeable manner provided by the Murray innovation. Next U.S. Pat. No. 1,822,392 issued to Esterman et al in 1929 shows a finger ring and two side bands. No interchangeability or anti turn, as in Murray, is taught.

Finally, Patent No. EP 0668033 issued to Jimenez in 1995 shows a multiple part ring system. This fails to show the interchangeable manner provided by the Murray innovation and the simplicity of two interlocking components.

As far as known, there are no interlocking ring systems and devices with interchangeable outer jackets and center rings.

It is believed that this product is unique in its design and technologies.

SUMMARY OF THE INVENTION

This new device/process may be simply described as: A device for an interlocking ring system made of durable and formable materials that are configured to lock interchangeable outer jackets and interchangeable center rings called a TULIP which is comprised with: (a) a center ring, ornate and decorative or smooth and with or without gemstones, the center ring in various mounting styles such as prong, bezel, pave etc.; and (b) a jacket as an outer band, held together by one or more straps, the jacket being ornate and with or without gemstones and made of the same, complimentary or contrasting materials as the center ring wherein the interchangeable outer jackets and center rings provide an interchangeable, stylish combination of interlocking jackets and center rings called a TULIP.

Objects and Advantages

Advantages and Benefits of the system and interchangeable, interlocking devices:

| Item | Advantages |
|---|---|
| 1 | Is flexible and versatile |
| 2 | Can have multiple- anti-turn geometric, regular and irregular polygons that are locking shapes that prevent the center ring from turning/anti rotate feature |
| 3 | Is cost effective use of several rings interchangeably |
| 4 | Is stylish for most all occasions |
| 5 | Is useful with custom made jewelry as well as mass produced |
| 6 | Has many combinations of center and jackets |
| 7 | Locks center ring into alignment without soldering therefor all center rings and jacket are interchangeable |
| 8 | Provides a system of interchangeable center rings and jackets |

-continued

| Item | Advantages |
|---|---|
| 9 | Consists of multiple center rings and jackets for many combinations. For example, five (5) center rings and five (5) jackets enabling one to have twenty-five (25) different combinations |
| 10 | Can create hundreds of combinations |
| 11 | Allows, with the locking shape, for all the center rings and jackets to be interchangeable with perfect alignment without soldering them together |
| 12 | Can be used as dinner ring (right hand) designs |
| 13 | Can be used as engagement ring (center ring) and wedding band (jacket) |
| 14 | Both center ring and jacket can also be worn by themselves without their counterpart - adding to the versatility. |

DESCRIPTION OF THE DRAWINGS

Figures

The accompanying drawings, which are incorporated in and constitute a part of this specification, illustrate an embodiment of the interlocking ring device with an outer jacket and center section with a setting that is preferred. The drawings together with the summary description given above and a detailed description given below serve to explain the principles of the interlocking ring device with an outer jacket and center section with a setting. It is understood, however, that the interlocking ring system and device with interchangeable outer jackets and center rings called a TULIP device is not limited to only the precise arrangements and instrumentalities shown.

FIGS. 4A through 4D are sketches of the locking configurations and some examples of the devices creating the systems anticipated with the interlocking ring system and device with interchangeable outer jackets and center rings called a TULIP.

DESCRIPTION OF THE DRAWINGS

Reference Numerals

Figure 1B:
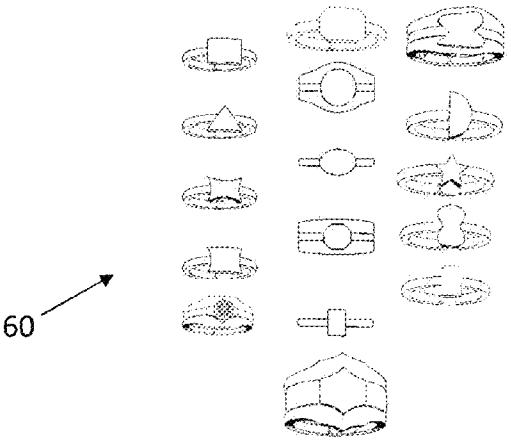
FIGS. 1A through 1D are sketches of an interlocking ring system and device with interchangeable outer jackets and center rings called a TULIP; examples of the device and uses of the system and device.
Figure 1D:
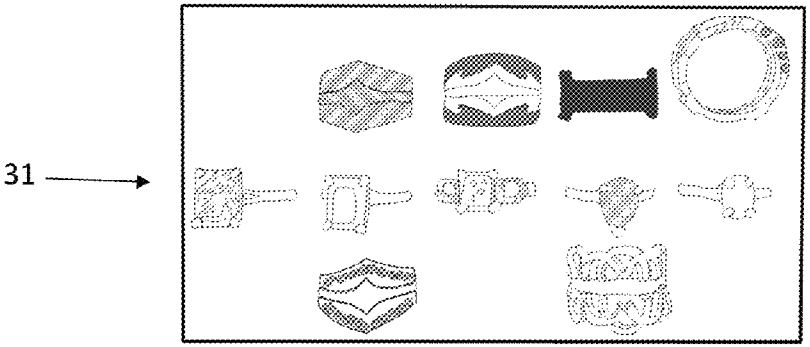
Figure 1A:
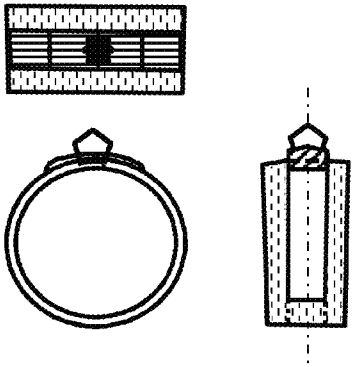
Figure 1C:
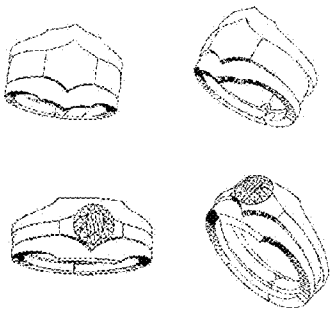

The following list refers to the drawings:

TABLE A

Reference numbers:

| Ref # | Description |
|---|---|
| 30 | an interlocking ring system and device with interchangeable outer jackets and center rings called a TULIP. |
| 31 | uses of the system and device |
| 32 | examples of the system and devices - plain plug 78 and gemstones 76, 77 |
| 33 | gemstone |
| 35 | Center ring - can be ornate and decorative or smooth; can be with or without gemstones; and can have various mounting styles - for example and not as a limitation prong, bezel, pave etc. |
| 36 | Chassis, base or shank |
| 37 | Mounting, prongs, heads - for example and not as a limitation prong, bezel, pave etc. |
| 38 | shoulder (with locking shape or configuration 60 essentially perpendicular to horizon and mating to inside of jacket configuration) |
| 38A | bottom of ring band (with locking shape or configuration 60 essentially perpendicular to horizon and mating to inside of jacket configuration at the lower portion of the jacket) |
| 39 | Center plugs, filler or blank - can be ornate and decorative or smooth; can be with or without other gemstones - can be essentially the same plane as the jacket 40 or slightly above or below jacket top plane 41 (see examples 391 and 392) |
| 40 | Jacket - outer bands - ornate and with or without gemstones; can be made of the same, complimentary or contrasting materials as the center ring 35 or plug 39 (jacket with aperture 60A to receive locking shape or configuration 60 and aperture is essentially perpendicular to horizon and mating to inside of jacket configuration) |
| 41 | Jacket top plane |
| 42 | Groove or opening for center ring 35 at the top and sides |
| 43 | Bottom groove or aperture for center ring 35 |
| 44 | Bottom notch (not open) at bottom of jacket 45 for center ring 35 (closed at the bottom circumference of the jacket 40) |
| 44A | Bottom portion of jacket with aperture 60A to receive locking shape or configuration 60 and aperture is essentially perpendicular to horizon and mating to inside of jacket configuration; configures with bottom of ring band 38A |
| 45 | straps |
| 50 | display device |
| 51 | recess for ring |
| 60 | Locking shapes - geometrical - that allows all the center rings and jackets to be interchangeable with perfect alignment without soldering them together - essentially parallel to aperture 60A and perpendicular to horizon; can be anti-turn geometric, regular and irregular polygons that are locking shapes that prevent the center ring from turning/anti rotate feature |
| 60A | shape of aperture in jacket essentially perpendicular to horizon and parallel to locking shape or configuration 60 of center ring or plug and mating to outside surface of center ring/plug configuration |
| 61 | example locking shape - preferred - diamond |
| 62 | example locking shape - elongated octagon |
| 63 | example locking shape - paper scroll |
| 64 | example locking shape - triangle |
| 65 | example locking shape - stretched rectangle |
| 66 | example locking shape - stretched square |
| 67 | example locking shape - traditional, regular octagon |
| 68 | example locking shape - traditional rectangle |
| 69 | example locking shape - irregular mushroom |
| 70 | example locking shape - essentially a circle |
| 71 | example locking shape - half moon |
| 72 | example locking shape - star |
| 73 | example locking shape - ellipse |
| 74 | example locking shape - dogbone |

TABLE A-continued

Reference numbers:

| Ref # | Description |
|---|---|
| 75 | example locking shape - book page |
| 76 | flat edged jacket with gemstone |
| 77 | angle edged jacket with gemstone |
| 78 | device 30 with a diamond blank 390 center ring |
| 79 | example locking shape - irregular polygon (number of sides may vary) |
| 79A | example locking shape - irregular curved shapes - flower petals etc. |
| 79B | example locking shape - irregular curved shapes - heart |
| 80 | prior art U.S. Pat. No. 5,228,316 |
| 81 | prior art U.S. Pat. No. 5,027,617 |
| 82 | prior art U.S. Pat. No. 4,493,196 |
| 83 | prior art U.S. Pat. No. 2,761,294 |
| 84 | prior art U.S. Pat. No. 2,262,513 |
| 85 | prior art U.S. Pat. No. 2,408,982 |
| 86 | prior art U.S. Pat. No. 2,151,607 |
| 87 | prior art U.S. Pat. No. 1,822,392 |
| 88 | Prior art European Patent - EP 0,668,033 |
| 351 | Center ring with tanzanite on a silver chassis |
| 352 | Center ring with emerald on a gold chassis |
| 353 | Center ring with sapphire on a silver chassis |
| 354 | Center ring with pink ice on a silver chassis |
| 355 | Center ring with topaz on a gold chassis |
| 390 | plug or a plain metal center ring |
| 391 | Plug made of gold |
| 392 | Plug made of silver |
| 401 | Band of gold |
| 402 | Band of rose gold with ornamentation |
| 403 | Band of gold with side diamonds |
| 404 | Band of gold with side diamonds and ornamentation |
| 405 | Band of silver with ornate scrolls |

DETAILED DESCRIPTION OF PREFERRED EMBODIMENT

The present development is an interlocking ring system and device with interchangeable outer jackets and center rings called a TULIP. This invention relates to jewelry having interchangeable elements and especially to jewelry rings which have a decorative feature mounted into a jacket band. This invention relates to a finger ring comprising an outer jacket and an inner center ring and, more particularly, to a finger ring, the center ring or plug of which is held contiguous and non-rotating by the configuration of an outer ring or jacket. Further, this invention relates generally to rings adapted to be worn on a person's finger, and in particular to a ring comprising detachably coupled members to permit replacement of the members. Moreover, the invention relates to a dual ring set which is generally worn on one finger. More specifically, the invention relates to a pair of rings such as a jacket and a center ring which are generally worn together on one finger. The dinner or engagement/wedding ring combination is generally a band with a single ornamental stone, often a diamond or other precious gemstones, or at most a cluster of ornamental stones concentrated in a limited portion of the band and a band with ornamentation with or without gemstones.

Figure 6:
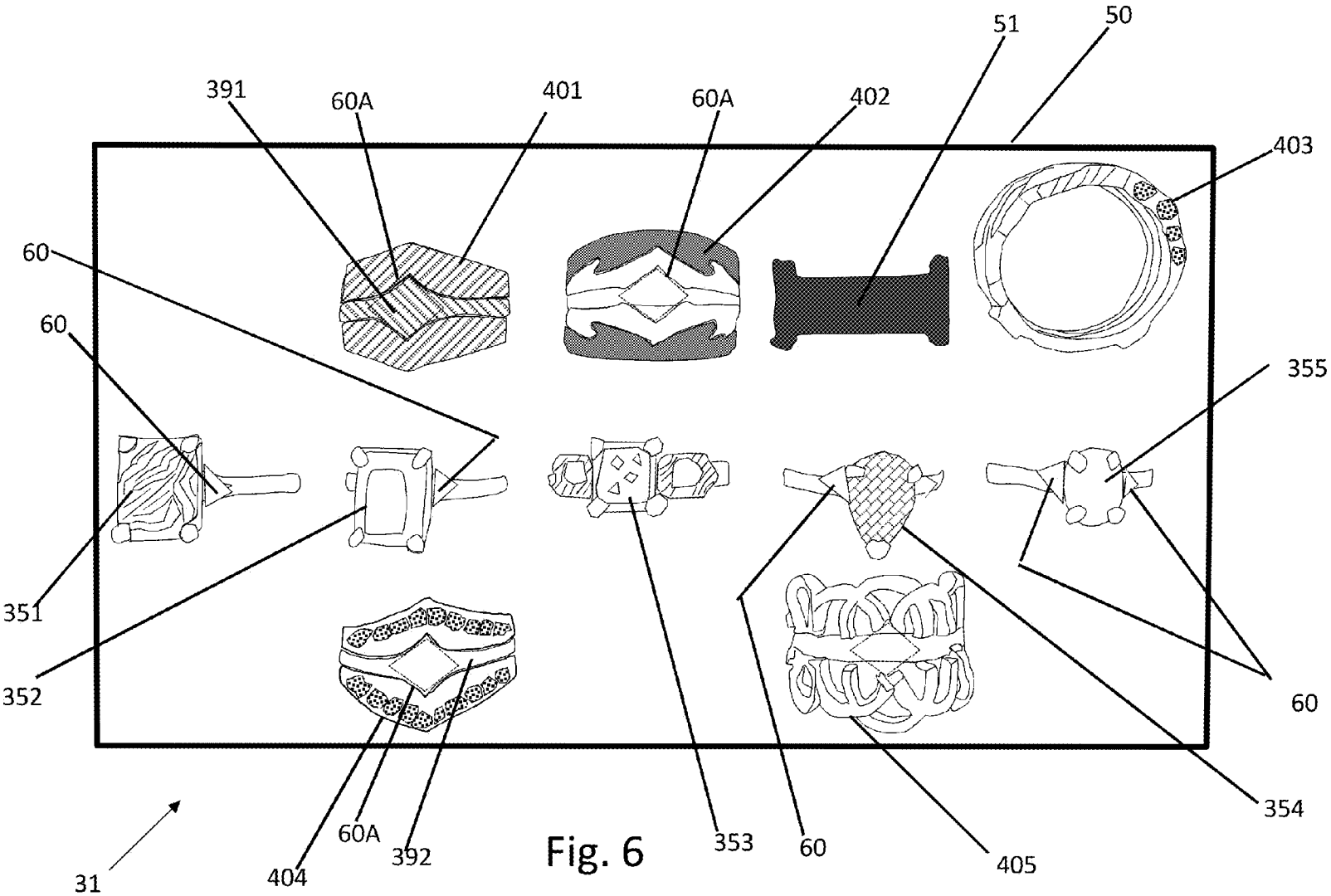
FIG. 6 is a sketch showing the use and operation of the interlocking ring system and device with interchangeable outer jackets and center rings called a TULIP.
Figures 7, 7A, 7B, 7C:
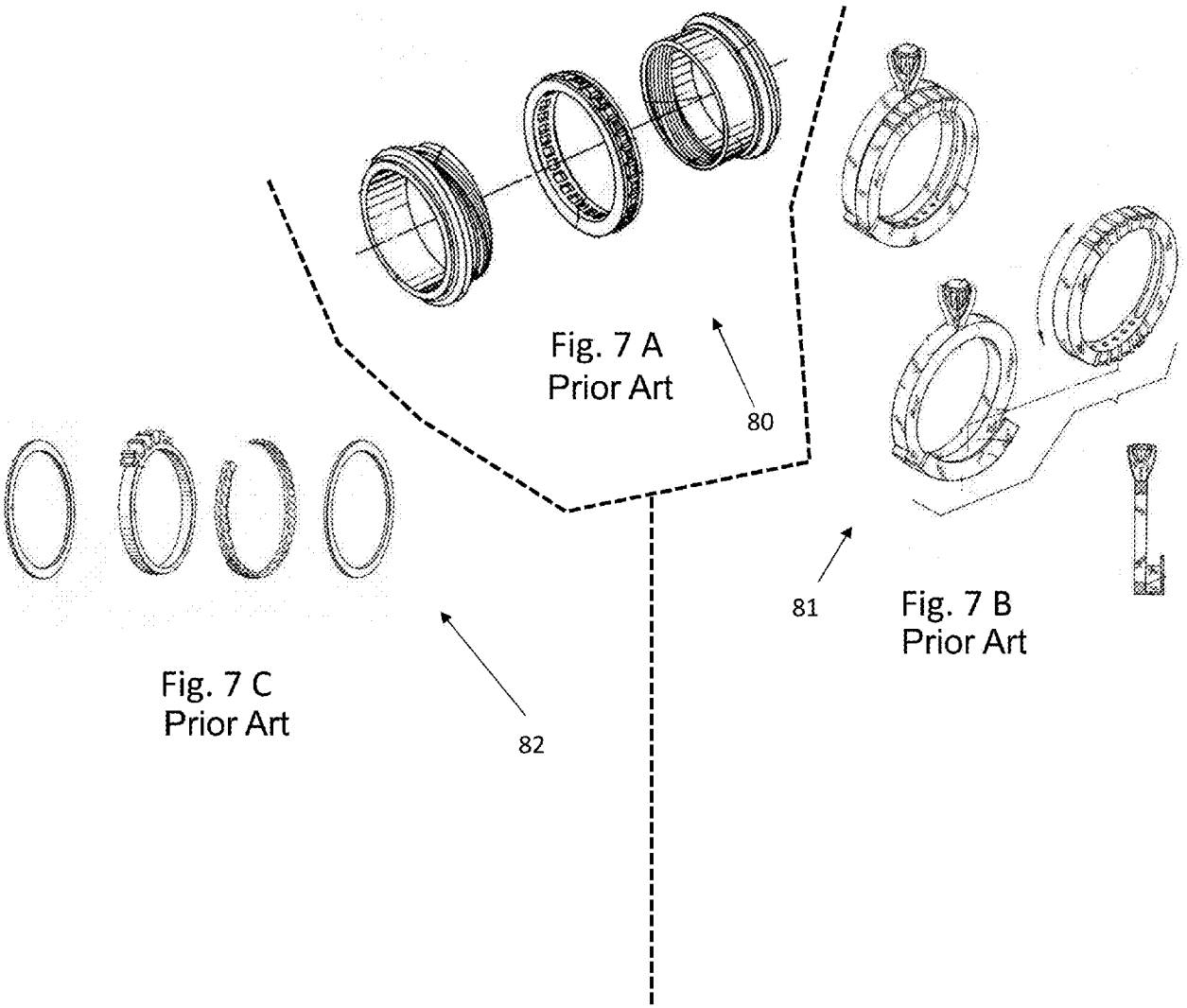
Fig. 7 A Prior Art
Fig. 7 B Prior Art
Fig. 7 C Prior Art
FIGS. 7 A through 7 C, FIGS. 8 A through 8 C, and FIGS. 9 A through 9 C, are examples of prior art for ring devices and systems.
Figure 8:
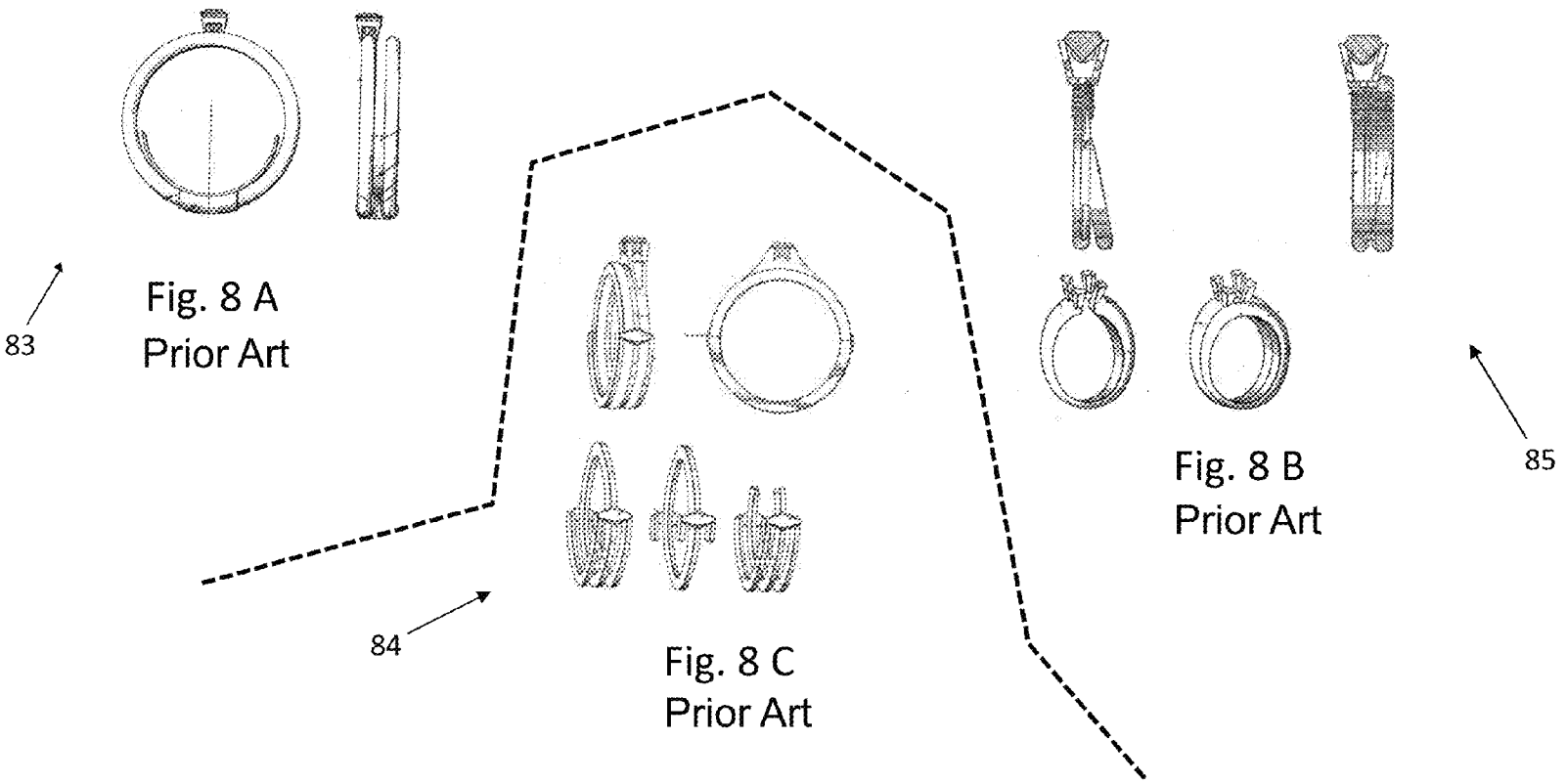
Figures 9, 9A, 9B, 9C:
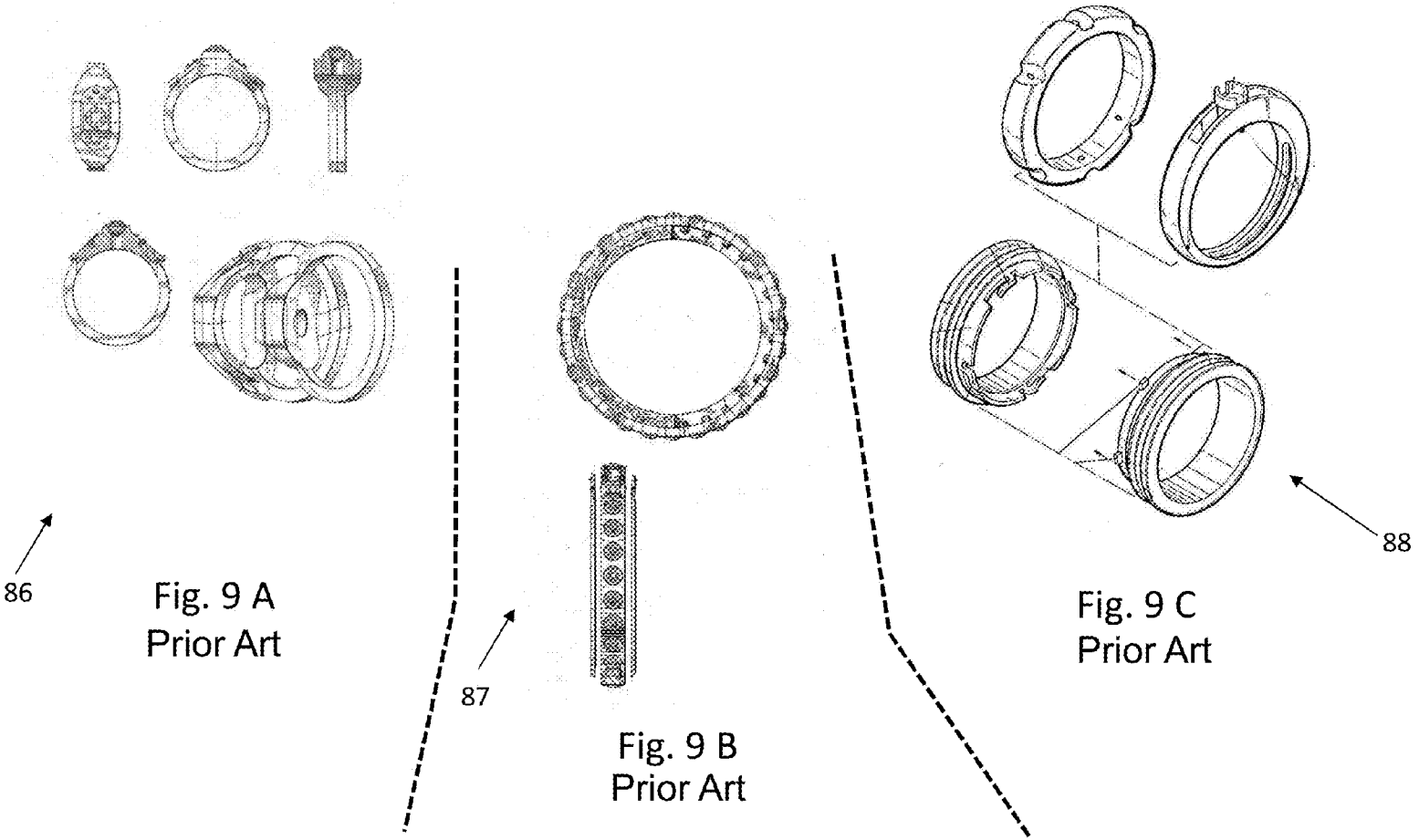
Fig. 9 C Prior Art
Fig. 9 B Prior Art
Fig. 9 A Prior Art

There are shown in FIGS. 1-9 a description and operative embodiment of the interlocking ring system and device 30 with interchangeable outer jackets and center rings called a TULIP. In the drawings and illustrations, one notes well that the FIGS. 1-6 demonstrate the general configuration, and FIGS. 4C and 4D, FIG. 5C, FIG. 5D and FIG. 6 show examples but not limitations of an interlocking ring system and device 30 with interchangeable outer jackets and center rings called a TULIP. The various example uses are in the operation and use section, below. Next, the FIGS. 7, 8 and 9 provide and show some prior art.

The accompanying drawings, which are incorporated in and constitute a part of this specification, illustrate an embodiment of the interlocking ring system and device 30 with interchangeable outer jackets and center rings called a TULIP. that is preferred. The drawings together with the summary description given above and a detailed description given below serve to explain the principles of an interlocking ring system and device 30 with interchangeable outer jackets and center rings called a TULIP.

There are several advantages of the interlocking ring system and device 30 with interchangeable outer jackets and center rings called a TULIP. Examples of these advantages and not as limitations are that the system and devices:

A. Are flexible and versatile;
B. Can have multiple-anti-turn geometric, regular and irregular polygons that are locking shapes that prevent the center ring from turning/anti rotate feature
C. Are cost effective use of several rings interchangeably;
D. Are stylish for most all occasions;
E. Are useful with custom made jewelry as well as mass produced;
F. Have many combinations of center and jackets;
G. Lock the center ring into alignment without soldering therefor all center rings and jacket are interchangeable;
H. Provide a system of interchangeable center rings and jackets;
I. Consist of multiple center rings and jackets for many combinations. For example, five (5) center rings and five (5) jackets enabling one to have twenty-five (25) different combinations;
J. Can create hundreds of combinations;
K. Allow, with the locking shape, for all the center rings and jackets to be interchangeable with perfect alignment without soldering them together;
L. Can be used as dinner ring (right hand) designs;
M. Can be used as engagement ring (center ring) and wedding band (jacket); and
N. Both center ring and jacket can also be worn by themselves without their counterpart—adding to the versatility.

The preferred embodiment of this system made of durable and formable materials that are configured to be an interlocking and interchangeable ring system and device comprised of: (a) a interchangeable center ring, ornate and decorative or smooth and with or without gemstones, the center ring in various mounting styles such as prong, bezel, pave etc.; and (b) an interchangeable jacket as two outer bands connected by at least one strap, the jacket being ornate and with or without gemstones and made of the same, complimentary or contrasting materials as the center ring wherein the interchangeable outer jackets and center rings provide an interchangeable, stylish combination of interlocking jackets and center rings called a TULIP.

FIGS. 1A through 1D are sketches of an interlocking ring system and device 30 with interchangeable outer jackets and center rings called a TULIP; examples of the device and uses of the system and device. Shown here is the an interlocking ring system and device 30 with interchangeable outer jackets and center rings called a TULIP; the locking shapes 60—geometrical—that allow all the center rings and jackets of the same locking shape and configuration to be interchangeable with perfect alignment without soldering them together; examples 32 of the system and devices; and uses 31 of the system and device. By having a unique locking shape 60 permits the owner to have a specific interchangeable set. Also, by using different locking shapes, different rings in a series may be offered the client/customer at the same time or on different occasions.

Figures 2, 2A, 2B, 2C, 2D:
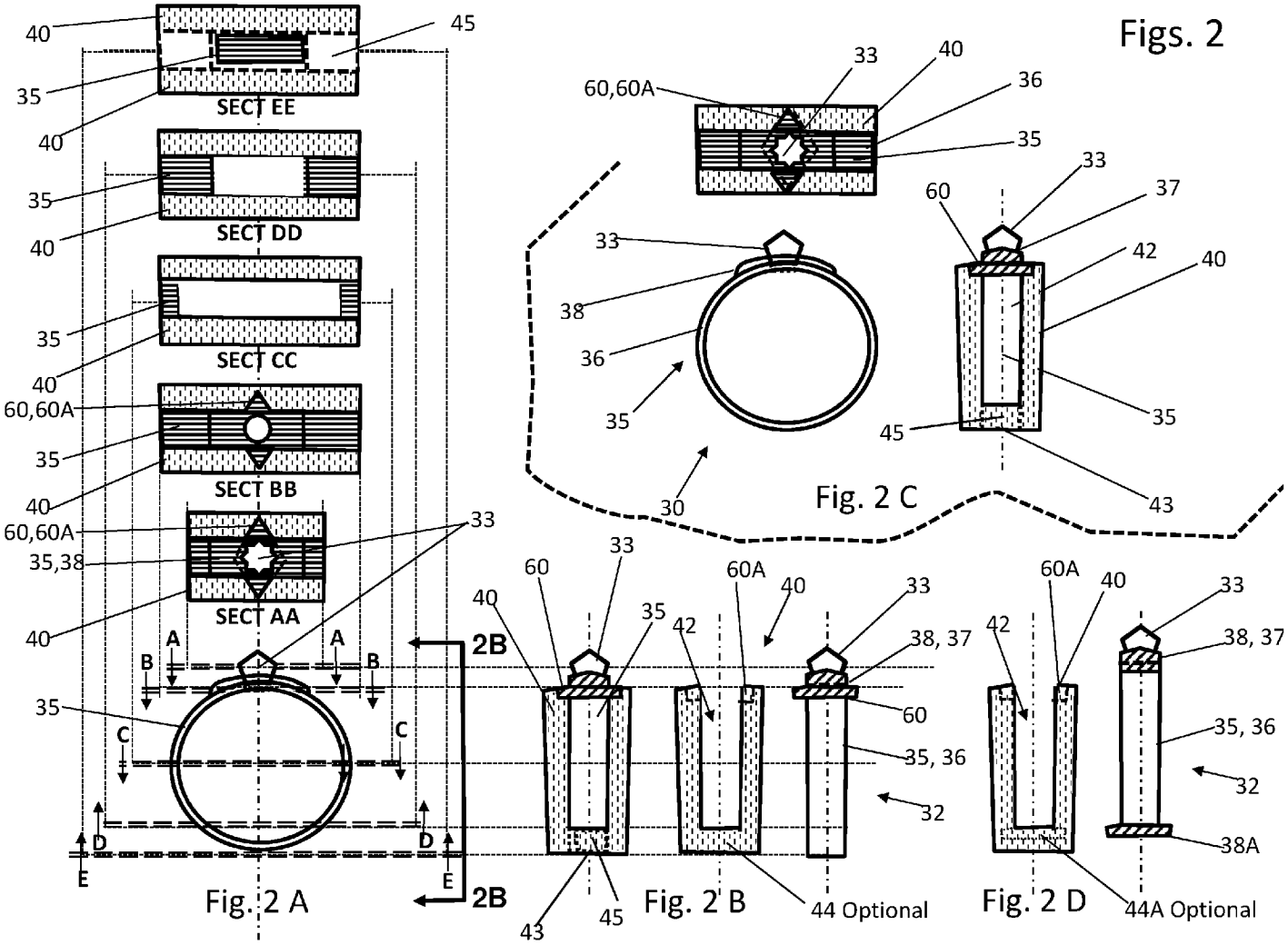
FIGS. 2A through 2D are sketches of an interlocking ring system and device with interchangeable outer jackets and center rings called a TULIP.

FIGS. 2 A through 2 D are sketches of an interlocking ring system and device 30 with interchangeable outer jackets 40 and center rings 35 called a TULIP. Demonstrated here are the components and features including: an interlocking ring system and device 30 with interchangeable outer jackets and center rings called a TULIP; gemstone 33; center ring 35—can be ornate and decorative or smooth; can be with or without gemstones; and can have various mounting styles—for example and not as a limitation prong, bezel, pave etc.; chassis 36, base or shank; mounting, prongs, heads 37—for example and not as a limitation prong, bezel, pave etc.; shoulder 38 (with locking shape or configuration 60 essentially perpendicular to horizon and mating to inside of jacket aperture 80A and configuration); jacket 40—outer bands—ornate and with or without gemstones; can be made of the same, complimentary or contrasting materials as the center ring 35 or plug 39; groove or opening 42 for center ring 35 at the top and sides; bottom groove or aperture 43 for center ring 35 bottom notch 44 (not open) at bottom of jacket 40 for center ring 35 (closed at the bottom circumference of the jacket 40); and straps 45. The preferred configuration is an open groove 43. Note that also shown are the shape of aperture 60A in jacket, configured in the same locking shape as the center ring, at the top and essentially perpendicular to horizon and parallel to locking shape 60 or configuration 60 of center ring 35 or plug 39 and mating to outside surface of center ring/plug 35, 39 configuration. The shape with a locking structure 60 is configured at the top of the center ring. FIG. 2 D shows the alternative embodiment with the locking feature between the center ring 32 and the jacket 40 at the bottom of the bands. Shown here are a bottom of ring band 38A (with locking shape or configuration 60 essentially perpendicular to horizon and mating to inside of jacket configuration at the lower portion of the jacket) and a bottom portion of jacket 44A with aperture 60A to receive locking shape or configuration 60 and aperture is essentially perpendicular to horizon and mating to inside of jacket configuration; configures with bottom of ring band 38A. The materials used to produce or craft the center ring and jackets may be from various durable and formable materials. For example and not as a limitation, the materials may be any of the precious metals like gold, silver, platinum; alternative metals like tungsten or titanium; ceramics; composite materials. It is conceivable that some series for children and "fashion fads" can as well be non-precious metals like copper, tin, aluminum, steel, pewter, and brass and other materials such as plastics.

Figure 3:
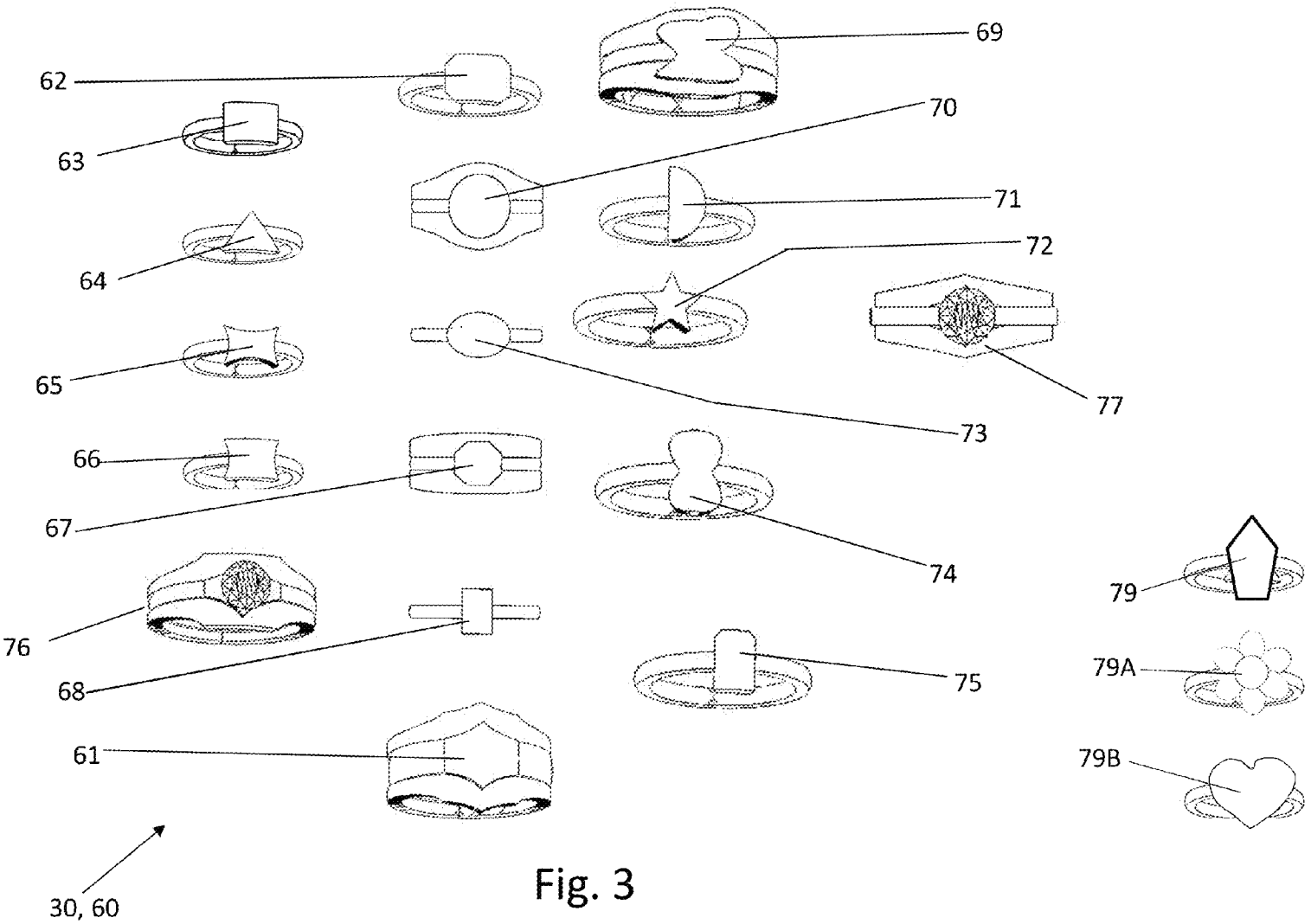
FIG. 3 is a sketch of the various regular and irregular locking shapes or geometrical configurations that allow the center rings and jackets to be interchangeable with perfect alignment.
Figure 5:
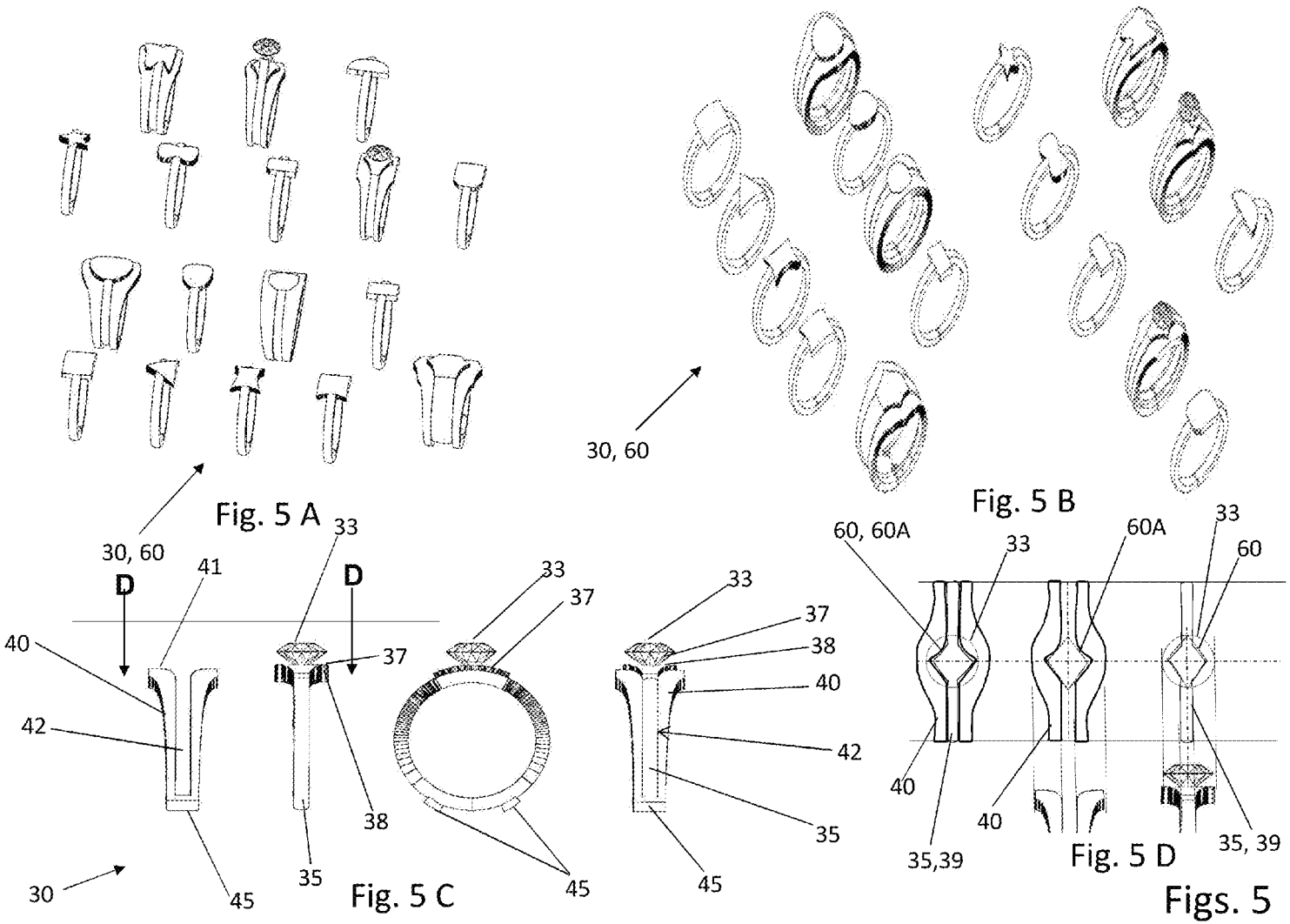
FIGS. 5A through 5D are additional sketches of the locking configurations and some examples of the devices creating the systems anticipated with the interlocking ring system and device with interchangeable outer jackets and center rings called a TULIP.

FIG. 3 is a sketch of the various locking shapes or geometrical configurations 60 that allow the center rings 35 and jackets 40 to be interchangeable with perfect alignment. Shown here are the various examples, and not limitations, of locking geometry including: example of the locking shape is preferred—a diamond 61; example locking shape—elongated octagon 62; example locking shape—paper scroll 63; example locking shape—triangle 64; example locking shape—stretched rectangle 65; example locking shape—stretched square 66; example locking shape—traditional, regular octagon 67; example locking shape—traditional rectangle 68; example locking shape—irregular mushroom 69; example locking shape—essentially a circle 70; example locking shape—half moon 71; example locking shape—star 72; example locking shape—ellipse 73; example locking shape—dogbone 74; example locking shape—book page 75; example locking shape—irregular polygon 79 (number of sides may vary); and example locking shape—irregular curved shapes—heart 79B, flower petals 79A etc. The shapes may be anti-turn geometric, regular and irregular polygons that are locking shapes that prevent the center ring from turning/anti rotate feature. Also shown in this FIG. 3 are a flat edged jacket with gemstone 76 and an angle edged jacket with gemstone 77.

FIGS. 4A through 4D are sketches of the locking configurations 60 as previously described and some examples of the devices 30 creating the systems anticipated with the interlocking ring system and device 30 with interchangeable outer jackets 40 and center rings 35 called a TULIP. These details are well described in the paragraph above for FIG. 3 and the specific elements therein. Note FIG. 4C shows a device 30, 78 with a diamond blank 390 as center ring.

FIGS. 5A through 5D are additional sketches of the locking configurations and some examples of the devices 30 creating the systems anticipated with the interlocking ring system and device with interchangeable outer jackets 40 and center rings 35 called a TULIP. Included are sketches of an interlocking ring system and device 30 and uses 60 with interchangeable outer jackets 40 and center rings 35 called a TULIP. Demonstrated here are the components and features including: an interlocking ring system and device 30 with interchangeable outer jackets and center rings called a TULIP; gemstone 33; center ring 35—can be ornate and decorative or smooth; can be with or without gemstones; and can have various mounting styles—for example and not as a limitation prong, bezel, pave etc.; chassis 36, base or shank; mounting, prongs, heads 37—for example and not as a limitation prong, bezel, pave etc.; shoulder 38; jacket 40—outer bands—ornate and with or without gemstones; can be made of the same, complimentary or contrasting materials as the center ring 35 or plug 39; jacket top plane 41; groove or opening 42 for center ring 35 at the top and sides; bottom groove or aperture 43 for center ring 35 bottom notch 44 (not open) at bottom of jacket 40 for center ring 35 (closed at the bottom circumference of the jacket 40); and straps 45. FIG. 5 D shows the section view with the center ring 35 and/or plug 39 shown interiorly placed to the jacket 40. Likewise the aperture 60A in the jacket 40 and the locking configuration 60 are demonstrated. Note that the Locking shapes 60—geometrical—that allows all the center rings 35/plugs 39 and jackets 40 to be interchangeable with perfect alignment without soldering them together—these are essentially parallel to aperture 60A in the jacket 40 and perpendicular to horizon. Also, one may see that the Jacket 40 can be made of the same, complimentary or contrasting materials as the center ring 35 or plug 39 (jacket with aperture 60A to receive locking shape or configuration 60 and aperture is also essentially perpendicular to horizon and mating to inside of jacket configuration).

FIG. 6 is a sketch showing the use and operation of the interlocking ring system and device 30 with interchangeable outer jackets 40 and center rings 35. This is described as the operational section, below.

FIGS. 7A through 7C, FIGS. 8A through 8C, and FIGS. 9A through 9C, are examples of prior art for ring devices and systems. Here are shown prior art U.S. Pat. No. 5,228,316—80; prior art U.S. Pat. No. 5,027,617—81; prior art U.S. Pat. No. 4,493,196—82; prior art U.S. Pat. No. 2,761,294—83; prior art U.S. Pat. No. 2,262,513—84; prior art U.S. Pat. No. 2,408,982—85; prior art U.S. Pat. No. 2,151,607—86; prior art U.S. Pat. No. 1,822,392—87; and prior art European Patent—EP 0,668,033—88. These all differ significantly than the present interlocking ring system and device 30 with interchangeable outer jackets and center rings called a TULIP.

The details mentioned here for the system and device 30 are exemplary and not limiting. Other specific components and manners specific to describing an interlocking ring system and device 30 with interchangeable outer jackets and center rings called a TULIP may be added as a person having ordinary skill in the field of jewelry devices and systems and their uses well appreciates.

Operation of the Preferred Embodiment

The interlocking ring device 30 with an outer jacket 40 and center ring 35 section with a setting has been described in the above embodiment. The manner of how the device operates is described below.

The preferred embodiment of this system and device is an interlocking and interchangeable ring system and device comprised of: (a) a center ring, ornate and decorative or smooth and with or without gemstones, the center ring in various mounting styles such as prong, bezel, pave etc.; and (b) a jacket as two outer bands connected by at least one strap, the jacket being ornate and with or without gemstones and made of the same, complimentary or contrasting materials as the center ring wherein the interchangeable outer jackets and center rings provide an interchangeable, stylish combination of interlocking jackets and center rings called a TULIP.

FIGS. 4C and 4D, and FIG. 5C are sketches of the locking configurations 60 for the interlocking ring system and device 30 with interchangeable outer jackets 40 and center rings 35 called a TULIP, as previously described above and with some examples of the device 30 creating the systems anticipated with the interlocking ring system and device 30 with interchangeable outer jackets 40 and center rings 35 called a TULIP. Shown are the components and features including: an interlocking ring system and device 30 with interchangeable outer jackets and center rings called a TULIP; gemstone 33; center ring 35—which can be ornate and decorative or smooth; can be with or without gemstones; and can have various mounting styles—for example and not as a limitation—prong, bezel, pave etc.; chassis 36, base or shank; mounting, prongs, heads 37—for example and not as a limitation—prong, bezel, pave etc.; shoulder 38; jacket 40 with outer bands ornate and with or without gemstones; can be made of the same, complimentary or contrasting materials as the center ring 35 or plug 39; groove or opening 42 for center ring 35 at the top and sides; bottom groove or aperture 43 for center ring 35 bottom notch 44 (not open) at bottom of jacket 40 for center ring 35 (closed at the bottom circumference of the jacket 40); and straps 45.

In FIG. 6 is a sketch that shows the various components of the system—the interlocking ring system and device 30 with interchangeable outer jackets 40 and center rings 35 called a TULIP. One can see the manner the exterior surfaces of the locking shapes 60 of the center ring 35 and/or the plug 39 may directly and contiguously fit into the aperture 60A of the jacket 40. The jacket 40 with aperture 60A to receive locking shape or configuration 60 and aperture is essentially perpendicular to horizon and mating to inside of locking configuration 60. The shoulder of the center ring 35 and/or plug 39 (with locking shape or configuration 60) is essentially perpendicular to horizon and mating to inside of jacket 40 aperture configurations 60A. One also note the display case 50 and the recess in the display 51. The various other components shown here have been described above. One sees from this example all the many various combinations of the interlocking ring device 30 with an outer jacket 40 and center ring 35 section with the same locking feature 60. The combinations:

| | Band 40 Description | gold | rose gold with ornamentation | gold with side diamonds | gold with side diamonds and ornamentation | silver with ornate scrolls |
|---|---|---|---|---|---|---|
| | Band 40 | 401 | 402 | 403 | 404 | 405 |
| Center 35/Plug 39 | Description | | | Combination | | |
| 351 | ring with tanzanite on a silver chassis | 1 | 2 | 3 | 4 | 5 |
| 352 | ring with emerald on a gold chassis | 6 | 7 | 8 | 9 | 10 |
| 353 | ring with sapphire on a silver chassis | 11 | 12 | 13 | 14 | 15 |
| 354 | ring with pink ice on a silver chassis | 16 | 17 | 18 | 19 | 20 |
| 355 | ring with topaz on a gold chassis | 21 | 22 | 23 | 24 | 25 |
| 391 | Gold plug | 26 | 27 | 28 | 29 | 30 |
| 392 | Silver plug | 31 | 32 | 33 | 34 | 35 |

This table is exemplary and not a limitation of the device and system 30. This example shows that with only five different jackets 40 (i.e. 401, 402, 403, 404, and 405) used with the five center rings 35 (i.e. 351, 352, 353, 354, and 355) and two plugs 39 (i.e. 391 and 392), there are essentially thirty five (five (5) jackets times seven (7) center rings and plugs) different combinations available with the interlocking ring system and device 30. One notes that these unique combinations if the TULIP system 30 is selected by the owner for the specific occasion.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.).

References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the interlocking ring device 30 with an outer jacket 40 and center ring 35 section with a setting is not to be limited to only the disclosed embodiment of product. The features of the interlocking ring device 30 with an outer jacket and center section with a setting are intended to cover various modifications and equivalent arrangements included within the spirit and scope of the description.

What is claimed is:

1. An interlocking and interchangeable ring system made of durable and formable materials and comprised of:

(a) a center ring, configured in various mounting styles;

(b) a specific locking shape (60) configured at the top of the center ring, the locking shape being essentially parallel to a locking aperture (60A) in a top of a jacket and having sides essentially perpendicular to an horizon; and (c) the jacket, with the locking aperture (60A), configured in the specific locking shape (60) as the center ring, at the top of the jacket and the locking aperture (60A) in the top of the jacket having sides essentially perpendicular to the horizon, the jacket further comprised of a pair of outer bands connected by at least two straps at the exterior of the pair of outer bands and located near a bottom of the pair of outer bands wherein the locking shape (60) of the center ring and the locking aperture (60A) of the jacket mate and interlock a set of interchangeable outer jackets and a set of center rings provide an interchangeable, stylish combination of interlocking jackets and center rings called a TULIP.

2. The interlocking and interchangeable ring system according to claim 1 wherein the mounting styles of the center ring is selected from the group consisting of prong, bezel, and pave.

3. The device according to claim 1 wherein the specific locking shape is selected from the group consisting of a diamond; an elongated octagon; a paper scroll a triangle; a stretched rectangle; a stretched square; a regular octagon; a rectangle; an irregular mushroom; a circle; a half moon; a star; an ellipse; a dogbone; a book page; an irregular polygon; an irregular curved shapes, a heart; and a flower petal shape.

4. The device according to claim 1 wherein the durable and formable material is selected from the group consisting of gold; silver; platinum; tungsten; titanium; ceramics; and composite materials.

5. The device according to claim 1 wherein the durable and formable material is selected from the group consisting of copper; tin; aluminum; steel; pewter; brass and plastic.

6. The device according to claim 1 wherein the center ring is selected from the group consisting of ornate and decorative with gemstones, ornate and decorative with gemstones, a smooth finish without gemstones, and smooth finish with gemstones.

7. The device according to claim 1 wherein the jacket is selected from the group consisting of ornate and decorative without gemstones and ornate and decorative with gemstones.

8. An interlocking and interchangeable ring system made of durable and formable materials and comprised of:

(a) a center ring configured in various mounting styles;

(b) a specific locking shape (60) configured at the top of the center ring, the locking shape being essentially parallel to an aperture (60A) in a jacket and having sides essentially perpendicular to horizon; and (c) the jacket, with the locking aperture (60A), configured in the same specific locking shape (60) as the center ring, at the top of the jacket and the locking aperture (60A) having sides essentially perpendicular to horizon, the jacket further comprised of a pair of outer bands connected by at least two straps at the exterior of the pair of outer bands and located near a bottom of the pair outer bands wherein the locking shape (60) of the center ring and the locking aperture (60A) of the jacket are parallel and contiguous at their essentially parallel surface and a set of interchangeable outer jackets and a set of center rings provide an interchangeable, stylish combination of interlocking jackets and center rings called a TULIP.

* * * * *